US011063350B2

(12) United States Patent
Zweers

(10) Patent No.: US 11,063,350 B2
(45) Date of Patent: Jul. 13, 2021

(54) EDGE ENABLED VOID ANTENNA APPARATUS

(71) Applicant: Qorvo US, Inc., Greensboro, NC (US)

(72) Inventor: Jan-Willem Zweers, Nieuwleusen (NL)

(73) Assignee: Qorvo US, Inc., Greensboro, NC (US)

( * ) Notice: Subject to any disclaimer, the term of this patent is extended or adjusted under 35 U.S.C. 154(b) by 44 days.

(21) Appl. No.: 16/246,642

(22) Filed: Jan. 14, 2019

(65) Prior Publication Data

US 2020/0112089 A1 Apr. 9, 2020

Related U.S. Application Data

(60) Provisional application No. 62/740,803, filed on Oct. 3, 2018.

(51) Int. Cl.

| | |
|---|---|
| ***H01Q 1/52*** | (2006.01) |
| ***H01Q 5/30*** | (2015.01) |
| ***H01Q 21/06*** | (2006.01) |
| ***H01Q 21/00*** | (2006.01) |

(52) U.S. Cl.

CPC ..... *H01Q 1/521* (2013.01); *H01Q 5/30* (2015.01); *H01Q 21/0025* (2013.01); *H01Q 21/062* (2013.01)

(58) Field of Classification Search

CPC .. H01Q 1/521; H01Q 21/0025; H01Q 21/062; H01Q 5/30

USPC ..... 343/844

See application file for complete search history.

(56) References Cited

U.S. PATENT DOCUMENTS

2006/0250250 A1* 11/2006 Youn ..... G06K 19/07749 340/572.7
2007/0152881 A1* 7/2007 Chan ..... H01Q 5/35 343/700 MS
2013/0257454 A1* 10/2013 Mow ..... H01Q 5/328 324/619
2013/0293424 A1* 11/2013 Zhu ..... H01Q 1/243 343/702

(Continued)

OTHER PUBLICATIONS

Xu, Yanhui, et al., "Design of a Notched-Band Vivaldi Antenna With High Selectivity," IEEE Antennas and Wireless Propagation Letters, vol. 17, Issue 1, Jan. 2018, pp. 62-65.

(Continued)

*Primary Examiner* — Don P Le

(74) *Attorney, Agent, or Firm* — Withrow & Terranova, P.L.L.C.

(57) ABSTRACT

An edge enabled void antenna (EEVA) apparatus is provided. The EEVA apparatus includes a conductive plane and a void is created on a geometric perimeter of the conductive plane to form an EEVA. A radio frequency (RF) port is coupled to the void to receive an RF signal. The RF signal excites the conductive plane to induce an electrical current along the geometric perimeter of the conductive plane. The void can cause the electrical current to increase and decrease on the geometric perimeter of the conductive plane, thus causing an electromagnetic wave corresponding to the RF signal being radiated from the EEVA. By forming the EEVA on the geometric perimeter of the conductive plane, it may be possible to enable a well-functioning antenna apparatus with a small effective footprint, thus allowing multiple EEVAs to be provided in a space confined wireless device with sufficient isolation for improved RF performance.

20 Claims, 6 Drawing Sheets

(56) References Cited

U.S. PATENT DOCUMENTS

| | | | | |
|---|---|---|---|---|
| 2018/0358697 | A1* | 12/2018 | Zhou | H01Q 9/0407 |
| 2020/0112089 | A1* | 4/2020 | Zweers | H01Q 21/062 |

OTHER PUBLICATIONS

Yang, Deqiang, et al., "A Miniaturized Ultra-Wideband Vivaldi Antenna With Low Cross Polarization," IEEE Access, vol. 5, Oct. 24, 2017, pp. 23352-23357.

* cited by examiner

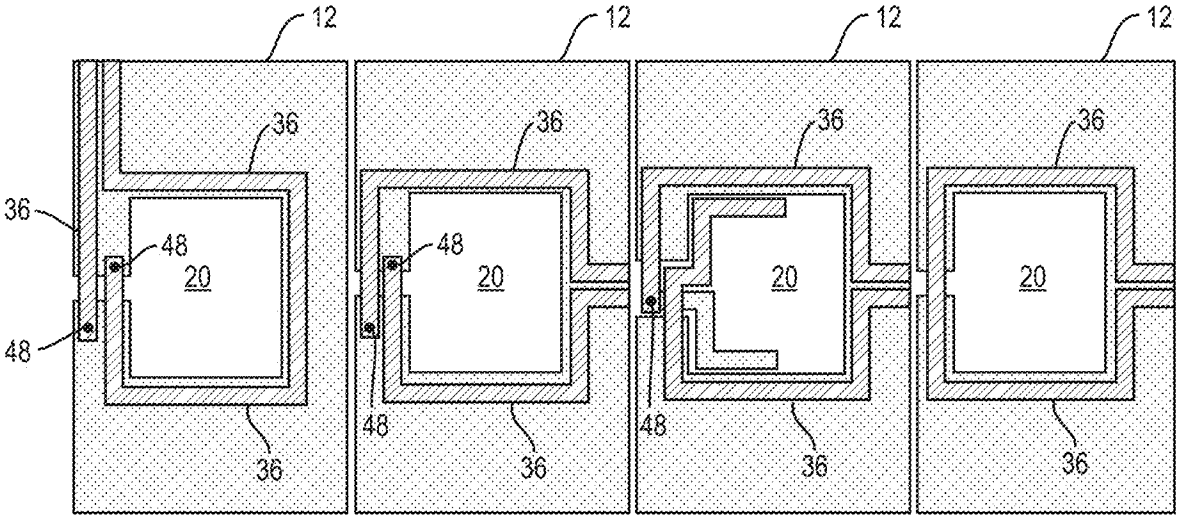
FIG. 2A
FIG. 2B
FIG. 2C
FIG. 2D
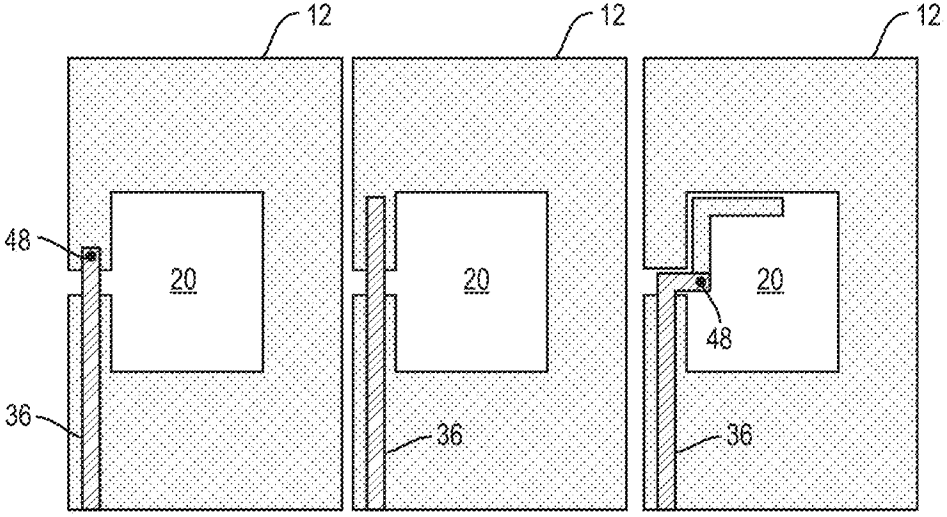
FIG. 2E
FIG. 2F
FIG. 2G

EDGE ENABLED VOID ANTENNA APPARATUS

RELATED APPLICATIONS

This application claims the benefit of provisional patent application Ser. No. 62/740,803, filed Oct. 3, 2018, the disclosure of which is hereby incorporated herein by reference in its entirety.

FIELD OF THE DISCLOSURE

The technology of the disclosure relates generally to a radio frequency (RF) antenna.

BACKGROUND

Wireless devices have become increasingly common in current society. The prevalence of these wireless devices is driven in part by the many functions that are now enabled on such devices. Increased processing capabilities in such devices means that wireless devices have evolved from being pure communication tools into sophisticated multimedia centers that can interact with a variety of connected devices in such wireless environments as the Internet-of-Things (IoT).

As capabilities of the wireless devices increase, so does the number of active and/or passive components in the wireless devices. Contrary to increased component count and integration complexity, form factor of the wireless devices has become more and more compact. As a result, real estate inside the form factor becomes increasingly scarce.

A wireless device may include a number of antennas to provide receive diversity and/or enable such advanced transmit mechanisms as multiple-input, multiple-output (MIMO) and beamforming. Notably, an antenna typically requires sufficient spatial separation from other active/passive components in the wireless device so as to effectively radiate an electromagnetic wave(s). As such, it may be desirable to provide as many antennas as needed in the wireless device, without having to increase footprint of the wireless device.

SUMMARY

Aspects disclosed in the detailed description include an edge enabled void antenna (EEVA) apparatus. The EEVA apparatus includes a conductive plane and a void is created on a geometric perimeter of the conductive plane to form an EEVA. A radio frequency (RF) port is coupled to the void and configured to receive a RF signal. The RF signal excites the conductive plane to induce an electrical current along the geometric perimeter of the conductive plane. The void can cause the electrical current to increase and decrease on the geometric perimeter of the conductive plane, thus causing an electromagnetic wave corresponding to the RF signal being radiated from the EEVA. By forming the EEVA on the geometric perimeter of the conductive plane, it may be possible to enable a well-functioning antenna apparatus with a very small effective footprint, thus allowing multiple EEVAs to be provided in a space confined wireless device with sufficient isolation for improved RF performance.

In one aspect, an EEVA apparatus is provided. The EEVA apparatus includes a conductive plane comprising an EEVA disposed on a geometric perimeter of the conductive plane. The EEVA includes an EEVA void having a defined perimeter and extending from the geometric perimeter of the conductive plane toward a geometric center of the conductive plane. The EEVA apparatus also includes an RF port coupled to the EEVA void and configured to receive an outgoing RF signal having a defined bandwidth of wavelength to cause an outgoing electromagnetic wave corresponding to the outgoing RF signal being radiated from the EEVA void.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

FIGS. 2A-2G are schematic diagrams providing exemplary illustrations of different methods for coupling a radio frequency (RF) port in the EEVA apparatus of FIG. 1A to an external transceiver circuit;

DETAILED DESCRIPTION

Figure 1B:
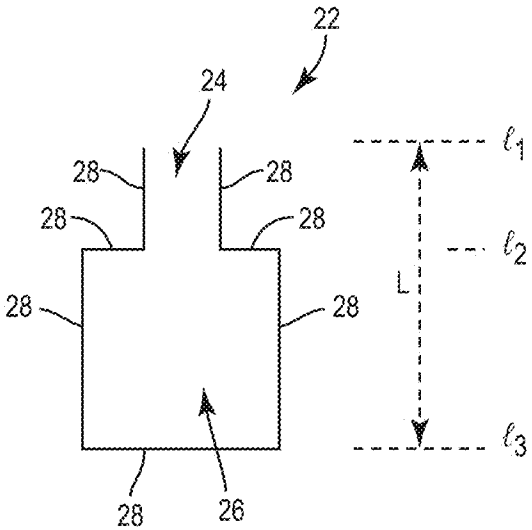
FIG. 1B is a schematic diagram providing an exemplary illustration of an octagonal-shaped void that can be created in a conductive plane in the EEVA apparatus of FIG. 1A to form an EEVA.

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

It will be understood that when an element such as a layer, region, or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. Likewise, it will be understood that when an element such as a layer, region, or substrate is referred to as being "over" or extending "over" another element, it can be directly over or extend directly over the other element or intervening elements may also be present. In contrast, when an element is referred to as being "directly over" or extending "directly over" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Aspects disclosed in the detailed description include an edge enabled void antenna (EEVA) apparatus. The EEVA apparatus includes a conductive plane and a void is created on a geometric perimeter of the conductive plane to form an EEVA. A radio frequency (RF) port is coupled to the void and configured to receive an RF signal. The RF signal excites the conductive plane to induce an electrical current along the geometric perimeter of the conductive plane. The void can cause the electrical current to increase and decrease on the geometric perimeter of the conductive plane, thus causing an electromagnetic wave corresponding to the RF signal being radiated from the EEVA. In addition, the void may enable the possibility of connecting an RF port of a transceiver to an edge of the conductive plane. Further, the void may provide an impedance to transform an electrical current along the void into a voltage. By forming the EEVA on the geometric perimeter of the conductive plane, it may be possible to enable a well-functioning antenna apparatus with a very small effective footprint, thus allowing multiple EEVAs to be provided in a space confined wireless device with sufficient isolation for improved RF performance.

Figure 1A:
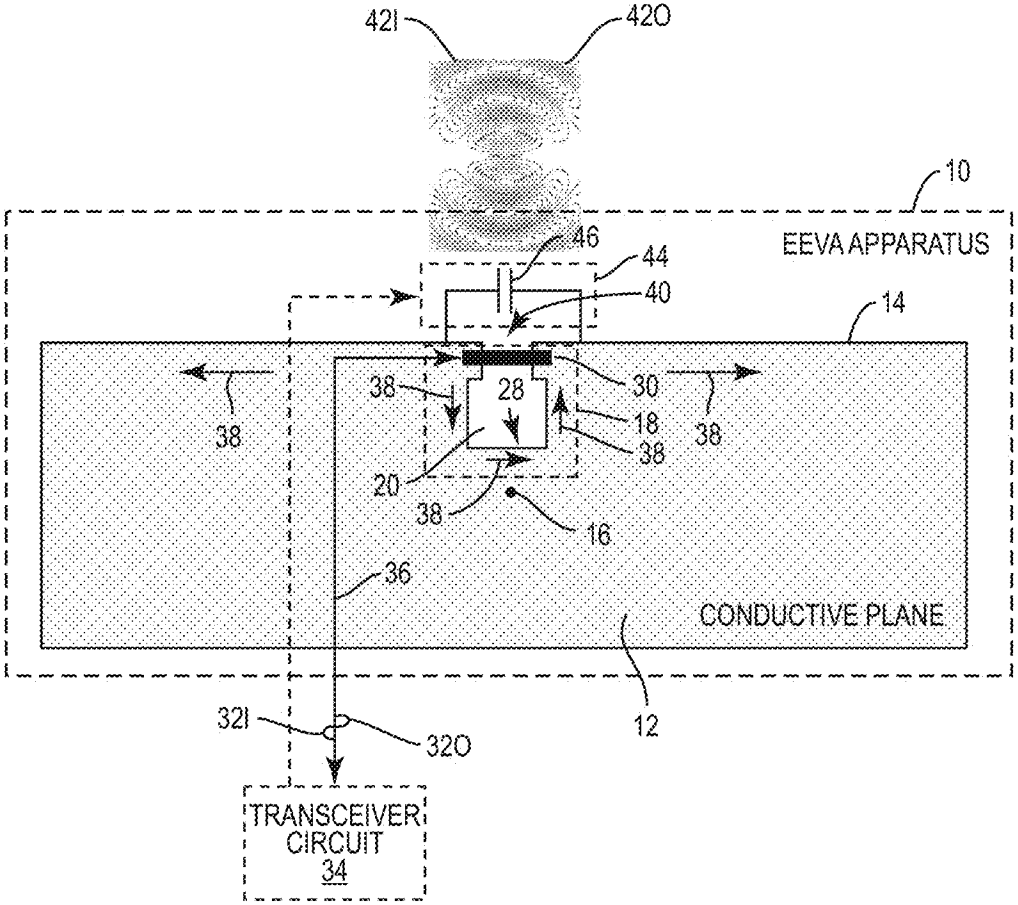
FIG. 1A is a schematic diagram of an exemplary edge enabled void antenna (EEVA) apparatus configured according to an embodiment of the present disclosure.

In this regard, FIG. 1A is a schematic diagram of an exemplary EEVA apparatus 10 configured according to an embodiment of the present disclosure. The EEVA apparatus 10 includes a conductive plane 12 having a defined geometric shape (e.g., polygonal-shaped or elliptical-shaped) and a defined thickness (e.g., up to 33 micrometers). For the convenience of illustration, a rectangular-shaped conductive plane is discussed hereinafter as a non-limiting example. It should be appreciated that the conductive plane 12 may be provided in any suitable shapes without altering the configuration and operation principles discussed herein.

The conductive plane 12 has a geometric perimeter 14 and a geometric center 16. Hereinafter, the geometric perimeter 14 refers to the continuous line forming a boundary of the conductive plane 12. For example, the geometric perimeter 14 can refer to the four edges of a rectangular-shaped conductive plane or the circle defining the circumference of a circular-shaped conductive plane.

According to an embodiment of the present disclosure, an EEVA 18 can be formed in the conductive plane 12 by creating an EEVA void 20 on the conductive plane 12. The EEVA void 20 extends from the geometric perimeter 14 toward the geometric center 16 of the conductive plane 12. The EEVA void 20 can be in any geometric shape (e.g., rectangular, circular, and so on). FIG. 1B is a schematic diagram providing an exemplary illustration of an octagonal-shaped void 22 that can be created in the conductive plane 12 of FIG. 1A as the EEVA void 20 to form the EEVA 18.

In a non-limiting example, the octagonal-shaped void 22 includes a first portion 24 (as shown between lines $l_1$ and $l_2$) and a second portion 26 (as shown between lines $l_2$ and $l_3$). The first portion 24 and the second portion 26 collectively define an electrical length L. The octagonal-shaped void 22 has a defined perimeter 28, which is collectively defined by edges of the first portion 24 and the second portion 26.

With reference back to FIG. 1A, the EEVA apparatus 10 includes an RF port 30 that is coupled to the conductive plane 12 and thus the EEVA void 20. Hereinafter, the EEVA void 20 and the RF port 30 collectively form the EEVA 18.

The RF port 30 is configured to receive an outgoing RF signal 32O. The outgoing RF signal 32O corresponds to a defined bandwidth of wavelength that is proportionally related to velocity and inversely related to frequency of the outgoing RF signal 32O. For example, if the velocity of the outgoing RF signal 32O in free space is $3\times10^8$ meters/second and the frequency of the outgoing RF signal 32O is 2.4 GHz, the defined bandwidth of wavelength of the outgoing RF signal 32O in free space is approximately 122 millimeters.

The RF port 30 may be coupled to a transceiver circuit 34 via a conductive trace 36 to receive the outgoing RF signal 32O. The outgoing RF signal 32O excites the conductive plane 12 to induce an electrical current 38. The electrical current 38 may be induced along the geometric perimeter 14 of the conductive plane 12 and the defined perimeter 28 of the EEVA void 20. The electrical current 38 generates a respective electric field (E-field) and a respective magnetic field (H-field). Notably, the H-field can cause RF energy being radiated into a correlated reflecting direction. As such, the EEVA void 20 created at the geometric perimeter 14 of the conductive plane 12 can cause a phase change of the electrical current 38 around the defined perimeter 28 of the EEVA void 20, thus creating a voltage potential at an opening 40 of the EEVA void 20. When impedance of the EEVA 18 matches impedance of the transceiver circuit 34, an outgoing electromagnetic wave 42O, which corresponds to the outgoing RF signal 32O, can be radiated very efficiently from the EEVA 18.

In this regard, the EEVA 18 is formed as part of the conductive plane 12. By forming the EEVA 18 on the geometric perimeter 14 of the conductive plane 12, it may be possible to enable a well-functioning antenna apparatus with a very small effective footprint. As illustrated later, it may be possible to form multiple EEVAs based on the conductive plane 12, thus allowing antennas to be provided in a small form factor wireless device (e.g., a handheld remote control, a smartphone, a wearable device, etc.) without increasing the footprint of the wireless device.

The EEVA apparatus 10 may include EEVA tuning circuitry 44 coupled in parallel to the EEVA void 20. In a non-limiting example, the EEVA tuning circuitry 44 includes a capacitor 46, which can be a voltage-controlled capacitor, a programmable capacitor matrix, an electronically controlled capacitor, a fixed value capacitor, or a microstrip capacitor, for example. Notably, the EEVA tuning circuitry 44 may also be configured to include an inductor, as opposed to the capacitor 46. The EEVA tuning circuitry 44 may be controlled, for example by the transceiver circuit 34, to cause the EEVA 18 to resonate at a primary resonate frequency. As further discussed later, the primary resonate frequency can be used as one of the tuning parameters for configuring the EEVA apparatus 10 to provide a dipole antenna(s) or to support such functionality as RF beamforming.

The RF port 30 may be coupled to the transceiver circuit 34 via the conductive trace 36 in a number of ways, as illustrated below in FIGS. 2A-2G. In this regard, FIGS. 2A-2G are schematic diagrams providing exemplary illustration of different methods for coupling the RF port 30 of FIG. 1A to the transceiver circuit 34. Common elements between FIGS. 1A and 2A-2G are shown therein with common element numbers and will not be re-described herein.

In FIGS. 2A, 2B, 2C, 2E, and 2G, the conductive plane 12 may be provided on one side (e.g., bottom side) of a printed circuit board (PCB) (not shown), while the conductive trace 36 is provided on an opposite side (e.g., top side) of the PCB. In this regard, the conductive trace 36 may be coupled to the conductive plane 12, and thus the EEVA void 20, by a conductive via(s) 48.

In contrast, as shown in FIGS. 2D and 2F, the conductive plane 12 and the conductive trace 36 may be provided on a same side (top side or bottom side) of the PCB. As such, the conductive via(s) 48 is not needed for coupling the conductive trace 36 to the conductive plane 12.

With reference back to FIG. 1A, the EEVA 18 can be further configured to absorb an incoming electromagnetic wave 421 corresponding to an incoming RF signal 32I. In a non-limiting example, the incoming RF signal 32I can be provided from the RF port 30 to the transceiver circuit 34 via the conductive trace 36.

When the EEVA 18 is formed on the geometric perimeter 14 of the conductive plane 12, the electrical current 38 is not bounded to any specific wavelength other than the length L of the EEVA void 20 relative to the dimension and shape of the conductive plane 12. In this regard, to help manipulate the electrical current 38 flowing along the geometric perimeter 14 of the conductive plane 12 to cause the outgoing electromagnetic wave 42O to be radiated in a desired radiation pattern, an edge enabled void isolator(s) (EEVI(s)) may be added to the EEVA apparatus 10.

Figure 3B:
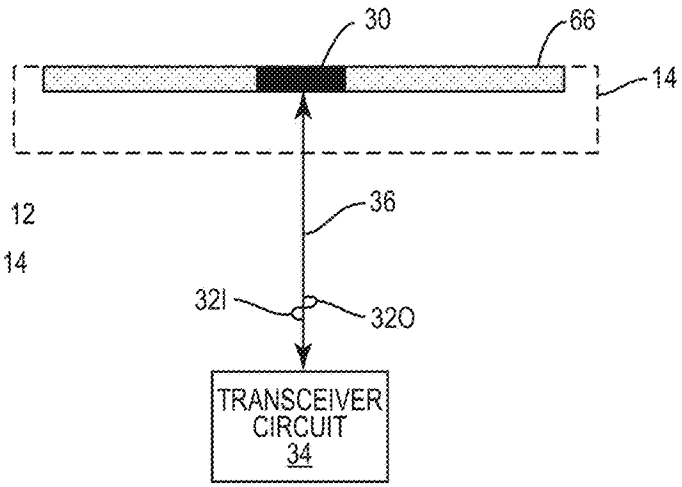
FIG. 3B is a schematic diagram of an exemplary dipole antenna than can be formed in the EEVA apparatus of FIG. 3A.
Figure 3A:
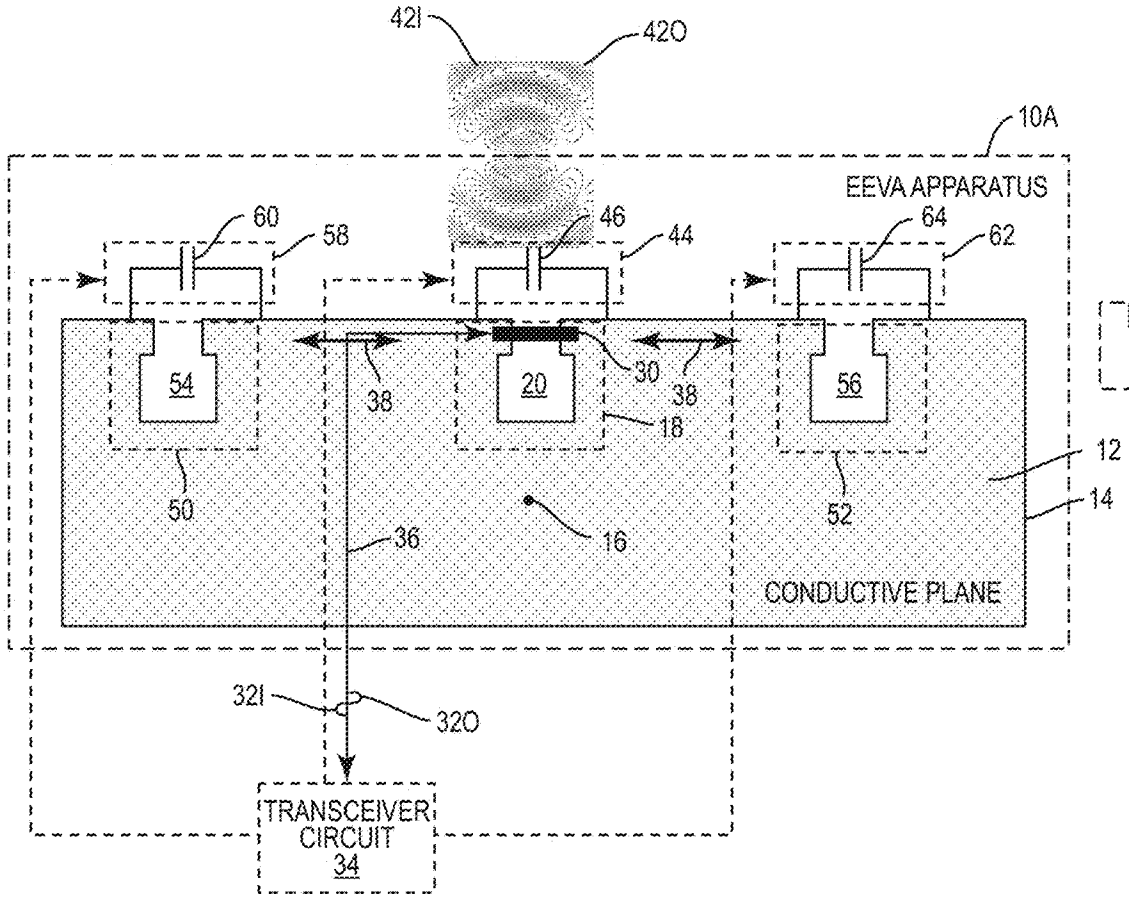
FIG. 3A is a schematic diagram of an exemplary EEVA apparatus adapted from the EEVA apparatus of FIG. 1A according to an embodiment of the present disclosure to incorporate a pair of edge enabled void isolators (EEVIs)

In this regard, FIG. 3A is a schematic diagram of an exemplary EEVA apparatus 10A adapted from the EEVA apparatus 10 of FIG. 1A according to an embodiment of the present disclosure to incorporate a first edge enabled void isolator (EEVI) 50 and a second EEVI 52. Common elements between FIGS. 1A and 3A are shown therein with common element numbers and will not be re-described herein.

The first EEVI 50 and the second EEVI 52 are provided on the geometric perimeter 14 of the conductive plane 12 in series to the EEVA 18. Notably, it may also be possible to provide the first EEVI 50 and the second EEVI 52 in parallel to the EEVA 18. Alternatively, it may also be possible to stack the first EEVI 50 and the second EEVI 52 with the EEVA 18. The first EEVI 50 includes a first EEVI void 54 and the second EEVI 52 includes a second EEVI void 56. It should be appreciated that the first EEVI void 54 and the second EEVI void 56 can be provided in any regular or irregular shape without affecting functionality of the first EEVI void 54 and the second EEVI void 56 discussed herein. By stacking the first EEVI 50 and the second EEVI 52 with the EEVA 18 or providing the first EEVI 50 and the second EEVI 52 in series to the EEVA 18, it may be possible to make the first EEVI 50, the second EEVI 52, and the EEVA 18 capable of supporting multiple RF bands.

In a non-limiting example, the first EEVI void 54 is provided on one side (e.g., left side) of the EEVA void 20 and the second EEVI void 56 is provided on an second side (e.g., right side) of the EEVA void 20 opposite the first side of the EEVA void 20. Similar to the EEVA void 20, each of the first EEVI void 54 and the second EEVI void 56 extends from the geometric perimeter 14 toward the geometric center 16 of the conductive plane 12.

The first EEVI void 54 is coupled in parallel to first EEVI tuning circuitry 58, which may include a first capacitor 60. The second EEVI void 56 is coupled in parallel to second EEVI tuning circuitry 62, which may include a second capacitor 64. Each of the first capacitor 60 and the second capacitor 64 can be a voltage-controlled capacitor, a programmable capacitor matrix, an electronically controlled capacitor, a fixed value capacitor, or a microstrip capacitor, for example.

The first EEVI tuning circuitry 58 and the second EEVI tuning circuitry 62 can be controlled, for example by the transceiver circuit 34, to cause the first EEVI 50 and the second EEVI 52 to resonate at a secondary resonate frequency. As previously discussed in FIG. 1A, the EEVA tuning circuitry 44 can be controlled, for example by the transceiver circuit 34, to cause the EEVA 18 to resonate at the primary resonate frequency. As such, it may be possible to concurrently or independently adjust the primary resonate frequency and/or the secondary resonate frequency to enable different functionalities in the EEVA apparatus 10A.

In one embodiment, it may be possible to control the EEVA tuning circuitry 44, the first EEVI tuning circuitry 58, and the second EEVI tuning circuitry 62 to cause the primary resonate frequency to equal the secondary resonate frequency. As such, the first EEVI 50 and the second EEVI 52 can cause the electrical current 38 to be substantially (e.g., >99.9%) reflected toward the EEVA 18. As a result, the EEVA 18, the first EEVI 50, and the second EEVI 52 collectively cause the EEVA apparatus 10 to function as a dipole antenna, as illustrated in FIG. 3B. In this regard, FIG. 3B is a schematic diagram of an exemplary dipole antenna 66 that can be formed in the EEVA apparatus 10A of FIG. 3A.

In another embodiment, it may be possible to control the EEVA tuning circuitry 44, the first EEVI tuning circuitry 58, and/or the second EEVI tuning circuitry 62 to cause the primary resonate frequency to differ from the secondary resonate frequency. As such, as opposed to reflecting the electrical current 38 substantially toward the EEVA 18, the first EEVI 50 and/or the second EEVI 52 may only reflect a portion of the electrical current 38 toward the EEVA 18, while allowing another portion of the electrical current 38 to flow around the first EEVI void 54 and/or the second EEVI void 56. As a result, the first EEVI void 54 and the second EEVI void 56 may cause a phase variation in the electrical current 38, thus causing a change in the radiation pattern of the outgoing electromagnetic wave 42O. Notably, by tuning the secondary resonate frequency to be different from the primary resonate frequency, it may also be possible to turn the first EEVI 50 and/or the second EEVI 52 into a separate antenna(s) by itself, thus allowing the EEVA apparatus 10A to radiate multiple beams of the outgoing electromagnetic wave 42O in support of RF beamforming.

In a non-limiting example, the first EEVI void 54 and the second EEVI void 56 can be configured in the same geometric shape as the octagonal-shaped void 22 of FIG. 1B. In this regard, the first EEVI void 54 and the second EEVI void 56 each includes the first portion 24 and the second portion 26, as shown in FIG. 1B. Accordingly, each of the first EEVI void 54 and the second EEVI void 56 has the length L as illustrated in FIG. 1B.

It may be possible to configure the first EEVI void 54 and/or the second EEVI void 56 to become an inductive void, a capacitive void, or a resistive void by varying the length L relative to the wavelength of the outgoing RF signal 32O. In one example, each of the first EEVI void 54 and the second EEVI void 56 can be an inductive void when the length L is less than one quarter (¼) of the wavelength of the outgoing RF signal 32O. In another example, each of the first EEVI void 54 and the second EEVI void 56 can be a capacitive void when the length L is greater than one quarter (¼) of the wavelength of the outgoing RF signal 32O. In another example, each of the first EEVI void 54 and the second EEVI void 56 can be a resistive void when the length L equals one quarter (¼) of the wavelength of the outgoing RF signal 32O.

Figure 4B:
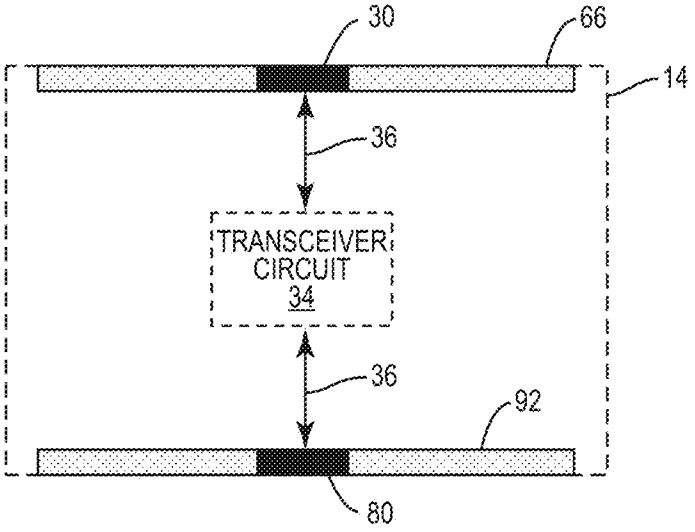
FIG. 4B is a schematic diagram providing an exemplary illustration of the dipole antenna of FIG. 3B and a second dipole antenna that can be formed in the EEVA apparatus of FIG. 4A.
Figure 4A:
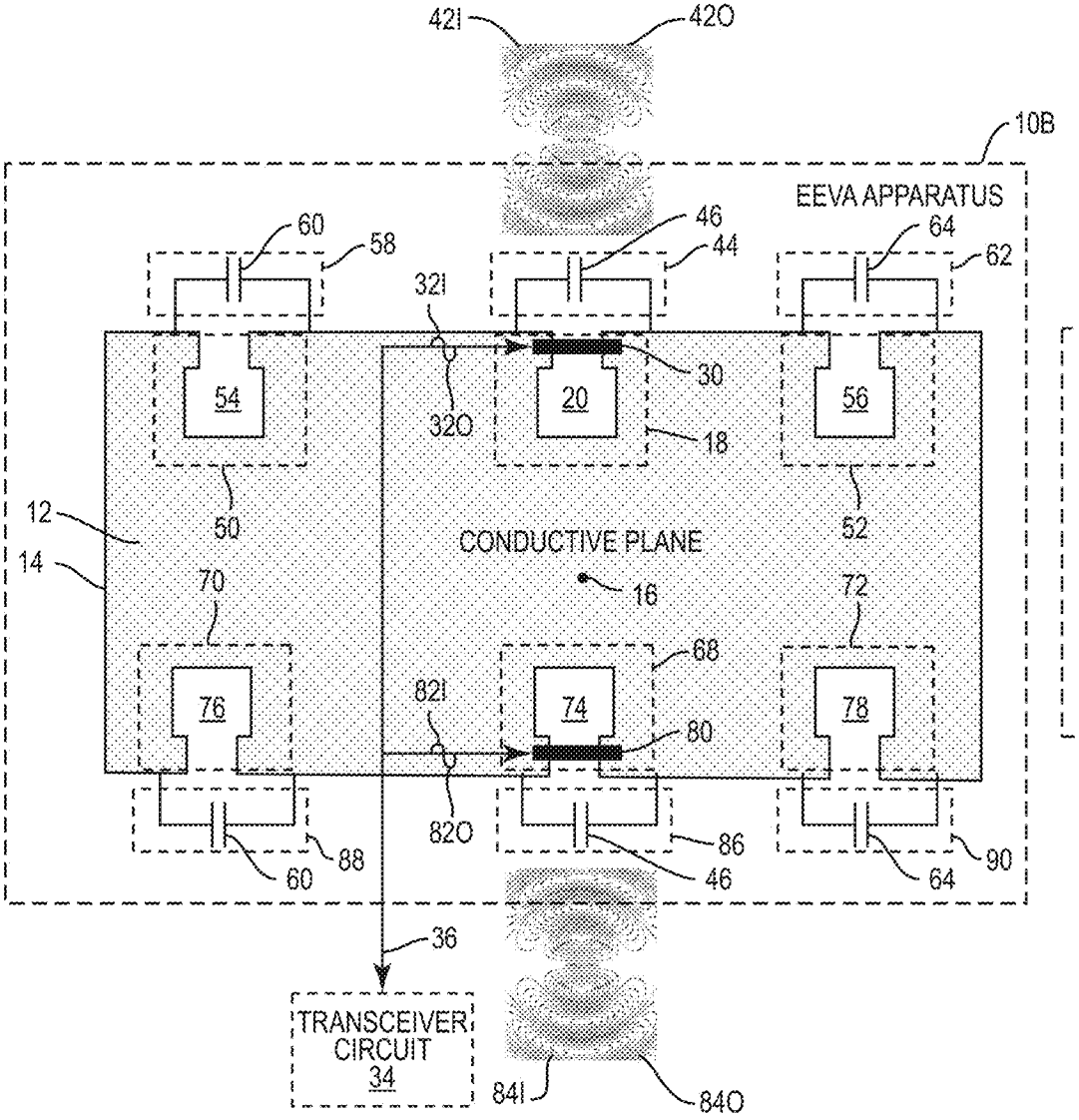
FIG. 4A is a schematic diagram of an exemplary EEVA apparatus adapted from the EEVA apparatus of FIG. 3A according to an embodiment of the present disclosure to incorporate multiple antennas.

The EEVA apparatus 10A may be adapted to incorporate multiple antennas. In this regard, FIG. 4A is a schematic diagram of an exemplary EEVA apparatus 10B adapted from the EEVA apparatus 10A of FIG. 3A according to an embodiment of the present disclosure to incorporate multiple antennas. Common elements between FIGS. 3A and 4A are shown therein with common element numbers and will not be re-described herein.

The EEVA apparatus 10B includes a second EEVA 68, a third EEVI 70, and a fourth EEVI 72 disposed in series on the geometric perimeter 14 of the conductive plane 12. In a non-limiting example, the second EEVA 68, the third EEVI 70, and the fourth EEVI 72 are disposed on an opposite edge of the geometric perimeter 14 relative to the EEVA 18, the first EEVI 50, and the second EEVI 52. The second EEVA 68 includes a second EEVA void 74 having a second defined perimeter and extending from the geometric perimeter 14 toward the geometric center 16 of the conductive plane 12. The third EEVI 70 includes a third EEVI void 76 extending from the geometric perimeter 14 toward the geometric center 16 of the conductive plane 12. The fourth EEVI 72 includes a fourth EEVI void 78 extending from the geometric perimeter 14 toward the geometric center 16 of the conductive plane 12. In a non-limiting example, the third EEVI void 76 and the fourth EEVI void 78 are provided on opposite sides of the second EEVA void 74. Notably, each of the second EEVA void 74, the third EEVI void 76, and the fourth EEVI void 78 can be in the same geometric shape as the octagonal-shaped void 22 of FIG. 1B.

The EEVA apparatus 10B includes a second RF port 80. In a non-limiting example, the second RF port 80 can be coupled to the conductive plane 12 and thus the second EEVA void 74 according to any of the coupling methods as illustrated in FIGS. 2A-2G. The second RF port 80 is configured to receive a second outgoing RF signal 82O of a second defined bandwidth of wavelength, for example from the transceiver circuit 34 via the conductive trace 36. The second outgoing RF signal 82O may be identical to or different from the outgoing RF signal 32O. Similar to the EEVA 18, the second EEVA 68 is configured to radiate a second outgoing electromagnetic wave 84O corresponding to the second outgoing RF signal 82O. In addition, the second EEVA 68 can also absorb a second incoming electromagnetic wave 84I corresponding to a second incoming RF signal 82I.

The EEVA apparatus 10B includes second EEVA tuning circuitry 86 coupled in parallel to the second EEVA void 74, third EEVI tuning circuitry 88 coupled in parallel to the third EEVI void 76, and fourth EEVI tuning circuitry 90 coupled in parallel to the fourth EEVI void 78. The second EEVA tuning circuitry 86, the third EEVI tuning circuitry 88, and the fourth EEVI tuning circuitry 90 are functionally equivalent to the EEVA tuning circuitry 44, the first EEVI tuning circuitry 58, and the second EEVI tuning circuitry 62.

The second EEVA tuning circuitry 86 may be controlled, for example by the transceiver circuit 34, to cause the second EEVA void 74 to resonate at a second primary resonate frequency. The third EEVI tuning circuitry 88 and the fourth EEVI tuning circuitry 90 may be controlled, for example by the transceiver circuit 34, to cause the third EEVI void 76 and the fourth EEVI void 78 to resonate at a second secondary resonate frequency. According to previous discussions in FIG. 3A, the second EEVA 68, the third EEVI 70, and the fourth EEVI 72 collectively form another dipole antenna when the second secondary resonate frequency is tuned to be equal to the second primary resonate frequency. FIG. 4B is a schematic diagram providing an exemplary illustration of the dipole antenna 66 of FIG. 3B and a second dipole antenna 92 that can be formed in the EEVA apparatus 10B of FIG. 4A.

With reference back to FIG. 4A, similar to the first EEVI 50 and the second EEVI 52, the third EEVI 70 and the fourth EEVI 72 may also be tuned to have the second secondary resonate frequency to differ from the second primary resonate frequency. In this regard, the third EEVI 70 and the fourth EEVI 72 can also cause a change in the radiation pattern of the second outgoing electromagnetic wave 84O. Notably, by tuning the second secondary resonate frequency to be different from the second primary resonate frequency, it may also be possible to turn the third EEVI 70 and/or the fourth EEVI 72 into a separate antenna(s) by itself, thus allowing the EEVA apparatus 10B to radiate multiple beams of the second outgoing electromagnetic wave 84O in support of RF beamforming.

It should be appreciated that it may be possible to tune the secondary resonate frequency of the first EEVI 50 and/or the second EEVI 52 to equal the primary resonate frequency of the EEVA 18, while tuning the second secondary resonate frequency of the third EEVI 70 and/or the fourth EEVI 72 to differ from the second primary resonate frequency of the second EEVA 68, or vice versa. As such, it may be possible to adapt the EEVA apparatus 10B to flexibly support a variety of application scenarios.

Notably, each of the EEVA void 20, the first EEVI void 54, the second EEVI void 56, the second EEVA void 74, the third EEVI void 76, and the fourth EEVI void 78 may be filled with a selected material (e.g., high permittivity or high permeability materials having lower losses). By filing each of the EEVA void 20, the first EEVI void 54, the second EEVI void 56, the second EEVA void 74, the third EEVI void 76, and the fourth EEVI void 78, it may be possible to shrink the sizes of these voids, thus helping to reduce the overall footprint of the EEVA apparatus 10B. In a non-limiting example, each of the EEVA void 20, the first EEVI void 54, the second EEVI void 56, the second EEVA void 74, the third EEVI void 76, and the fourth EEVI void 78 can be smaller than 5% of the wavelength in free space of the outgoing RF signal 32O and/or the second outgoing RF signal 82O. Accordingly, it may be possible to integrate one or more of the EEVA void 20, the first EEVI void 54, the second EEVI void 56, the second EEVA void 74, the third EEVI void 76, and the fourth EEVI void 78 into an integrated circuit (IC) or a chip housing.

Figure 4C:
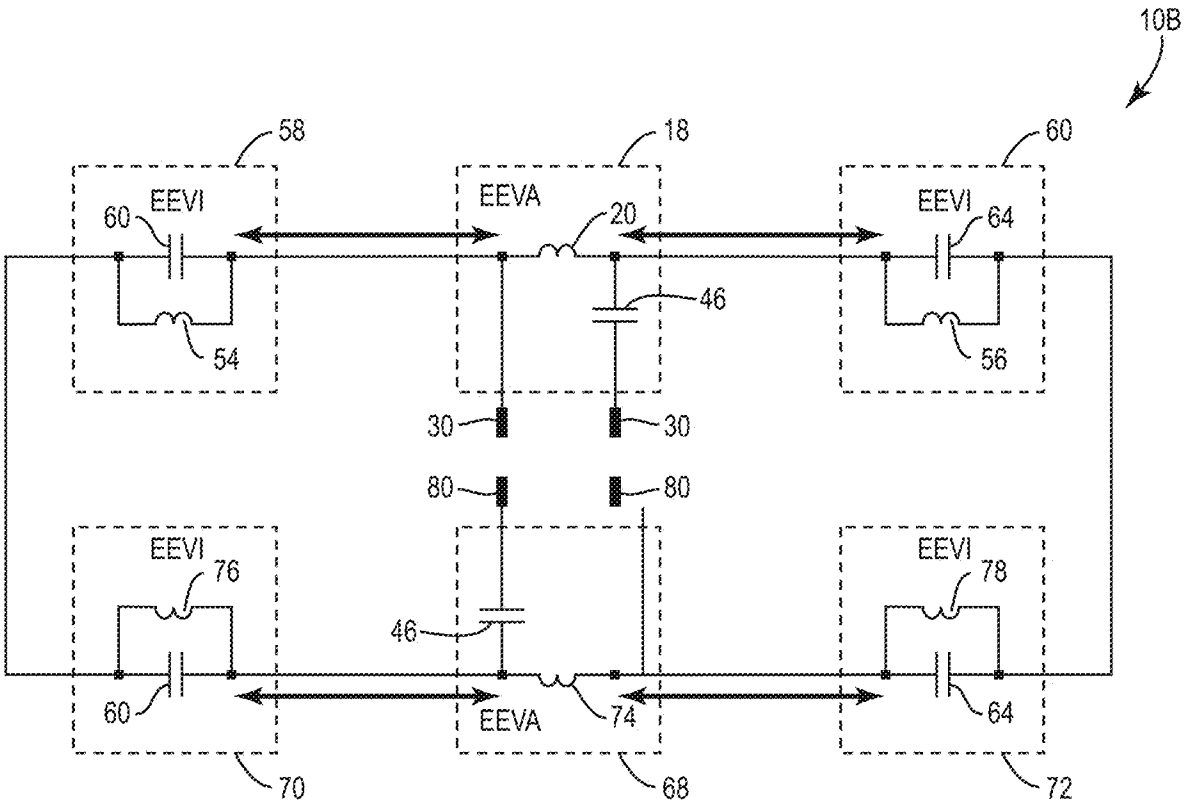
FIG. 4C is a schematic diagram of the EEVA apparatus of FIG. 4A configured to include a number of inductive voids.

FIG. 4C is a schematic diagram of the EEVA apparatus 10B of FIG. 4A in which each of the EEVA void 20, the first EEVI void 54, the second EEVI void 56, the second EEVA void 74, the third EEVI void 76, and the fourth EEVI void 78 is configured to function as an inductive void. Common elements between FIGS. 4A and 4C are shown therein with common element numbers and will not be re-described herein.

As previously discussed, an EEVA void or an EEVI void can be configured to function as an inductive void when the respective length L of the void is less than ¼ wavelength of the outgoing RF signal. In this regard, the length L of each of the EEVA void 20, the first EEVI void 54, and the second EEVI void 56 is less than ¼ wavelength of the outgoing RF signal 320, while the respective length L of the second EEVA void 74, the third EEVI void 76, and the fourth EEVI void 78 is less than ¼ wavelength of the second outgoing RF signal 82O.

Figure 5B:
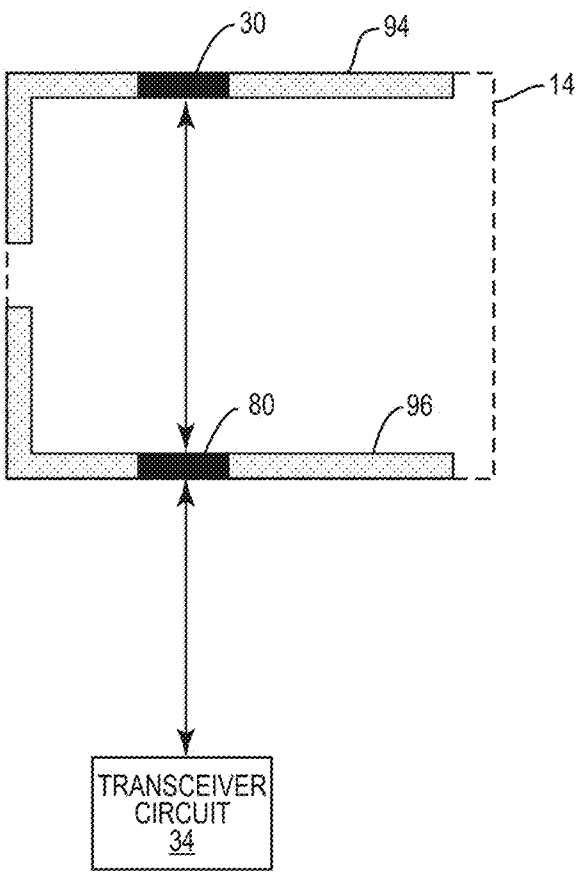
FIG. 5B is a schematic diagram providing an exemplary illustration of a pair of dipole antennas that can be formed in the EEVA apparatus of FIG. 5A.
Figure 5A:
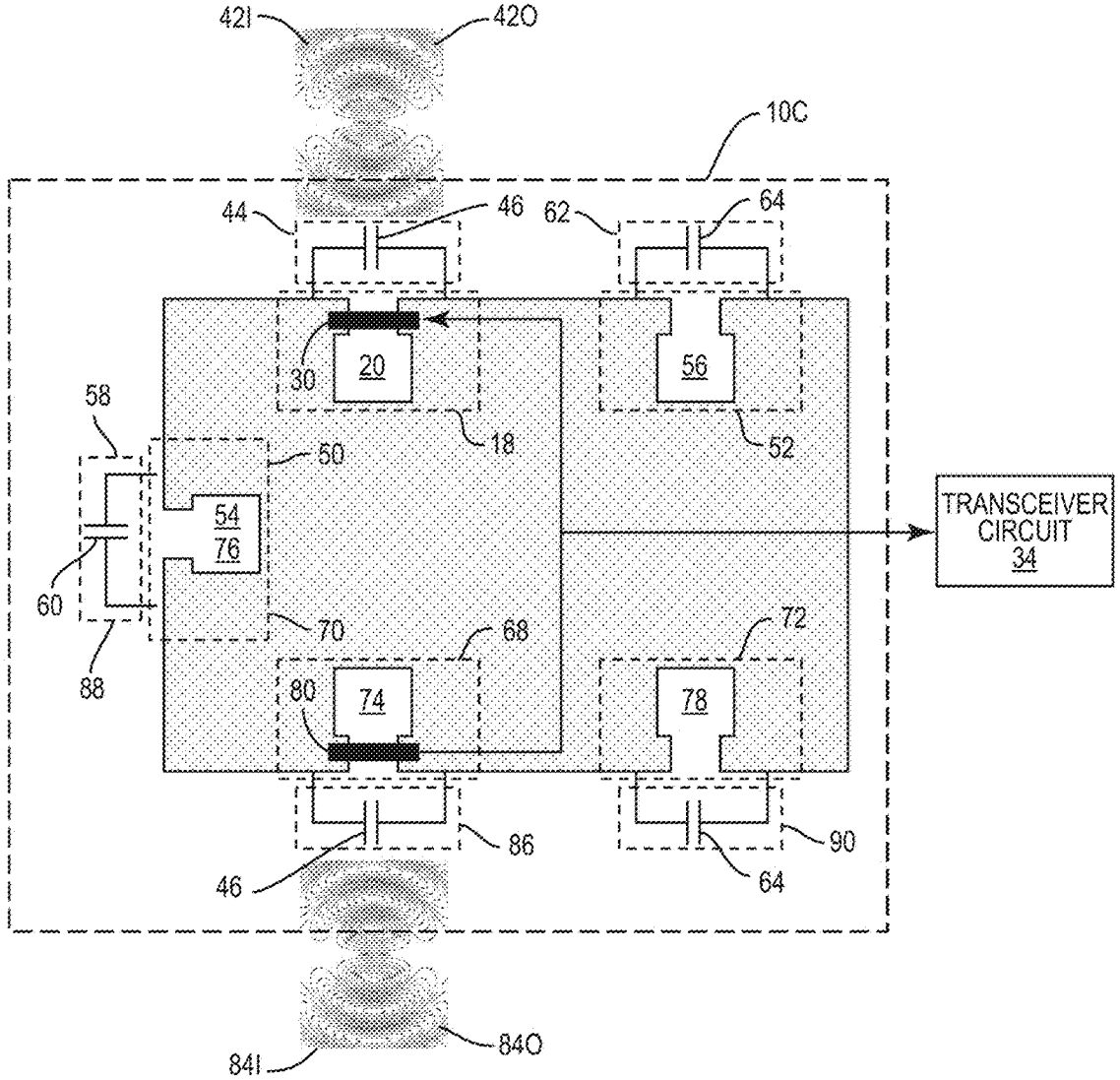
FIG. 5A is a schematic diagram of an exemplary EEVA apparatus configured according to another embodiment of the present disclosure.

FIG. 5A is a schematic diagram of an exemplary EEVA apparatus 10C configured according to another embodiment of the present disclosure.

Common elements between FIGS. 4A and 5A are shown therein with common element numbers and will not be re-described herein.

In the EEVA apparatus 10C, the first EEVI 50 is the same as the third EEVI 70. In this regard, the EEVA apparatus 10C can form a pair of dipole antennas 94, 96 by sharing the first EEVI 50 and the third EEVI 70. FIG. 5B is a schematic diagram providing an exemplary illustration of the pair of dipole antennas 94, 96 that can be formed in the EEVA apparatus 10C of FIG. 5A.

Those skilled in the art will recognize improvements and modifications to the preferred embodiments of the present disclosure. All such improvements and modifications are considered within the scope of the concepts disclosed herein and the claims that follow.

What is claimed is:

1. An edge enabled void antenna (EEVA) apparatus comprising:

a conductive plane comprising an EEVA disposed on a geometric perimeter of the conductive plane, the EEVA comprising an EEVA void having a defined perimeter and extending from the geometric perimeter of the conductive plane toward a geometric center of the conductive plane;

EEVA tuning circuitry coupled in parallel to the EEVA void; and a radio frequency (RF) port coupled to the EEVA void and configured to receive an outgoing RF signal having a defined bandwidth of wavelength to cause an outgoing electromagnetic wave corresponding to the outgoing RF signal being radiated from the EEVA void.

2. The EEVA apparatus of claim 1 wherein the outgoing RF signal is configured to excite the conductive plane to induce an electrical current along the defined perimeter of the EEVA void to cause the outgoing electromagnetic wave to be radiated from the EEVA void.

3. The EEVA apparatus of claim 1 wherein the EEVA tuning circuitry comprises a capacitor.

4. The EEVA apparatus of claim 2 wherein the conductive plane further comprises:

a first edge enabled void isolator (EEVI) disposed on the geometric perimeter and in series to the EEVA, the first EEVI comprising a first EEVI void extending from the geometric perimeter toward the geometric center; and a second EEVI disposed on the geometric perimeter and in series to the EEVA, the second EEVI comprising a second EEVI void extending from the geometric perimeter toward the geometric center.

5. The EEVA apparatus of claim 4 wherein each of the first EEVI void and the second EEVI void is configured to be an inductive void when a respective length is less than one quarter ($^1/_4$) of the defined bandwidth of wavelength of the RF signal.

6. The EEVA apparatus of claim 4 wherein each of the first EEVI void and the second EEVI void is configured to be a capacitive void when a respective length is greater than one quarter ($^1/_4$) of the defined bandwidth of wavelength of the RF signal.

7. The EEVA apparatus of claim 4 wherein each of the first EEVI void and the second EEVI void is configured to be a resistive void when a respective length is equal to one quarter ($^1/_4$) of the defined bandwidth of wavelength of the RF signal.

8. The EEVA apparatus of claim 4 further comprising:

EEVA tuning circuitry coupled in parallel to the EEVA void and configured to cause the EEVA to resonate at a primary resonate frequency;

first EEVI tuning circuitry coupled in parallel to the first EEVI void and configured to cause the first EEVI to resonate at a secondary resonate frequency; and second EEVI tuning circuitry coupled in parallel to the second EEVI void and configured to cause the second EEVI to resonate at the secondary resonate frequency.

9. The EEVA apparatus of claim 8 wherein the EEVA tuning circuitry, the first EEVI tuning circuitry, and the second EEVI tuning circuitry comprise a capacitor, a first capacitor, and a second capacitor, respectively.

10. The EEVA apparatus of claim 9 wherein each of the capacitor, the first capacitor, and the second capacitor is selected from the group consisting of: a voltage-controlled capacitor, a programmable capacitor matrix, an electronically controlled capacitor, a fixed value capacitor, and a microstrip capacitor.

11. The EEVA apparatus of claim 9 wherein the first EEVI tuning circuitry and the second EEVI tuning circuitry are configured to tune the secondary resonate frequency to equal the primary resonate frequency to cause the first EEVI and the second EEVI to substantially reflect the electrical current toward the EEVA.

12. The EEVA apparatus of claim 11 wherein the EEVA, the first EEVI, and the second EEVI are configured to collectively form a dipole antenna.

13. The EEVA apparatus of claim 9 wherein the first EEVI tuning circuitry and the second EEVI tuning circuitry are configured to tune the secondary resonate frequency to differ from the primary resonate frequency to cause a change in a radiation pattern of the outgoing electromagnetic wave.

14. The EEVA apparatus of claim 9 wherein the conductive plane further comprises:

a second EEVA disposed on the geometric perimeter of the conductive plane, the second EEVA comprising a second EEVA void having a second defined perimeter and extending from the geometric perimeter of the conductive plane toward the geometric center of the conductive plane;

a second RF port coupled to the second EEVA void and configured to receive a second outgoing RF signal having a second defined bandwidth of wavelength to cause a second outgoing electromagnetic wave corresponding to the second outgoing RF signal being radiated from the second EEVA void;

a third EEVI disposed on the geometric perimeter and in series to the second EEVA, the third EEVI comprising a third EEVI void extending from the geometric perimeter toward the geometric center; and a fourth EEVI disposed on the geometric perimeter and in series to the second EEVA, the fourth EEVI comprising a fourth EEVI void extending from the geometric perimeter toward the geometric center.

15. The EEVA apparatus of claim 14 further comprising:

second EEVA tuning circuitry coupled in parallel to the second EEVA void and configured to cause the second EEVA to resonate at a second primary resonate frequency;

third EEVI tuning circuitry coupled in parallel to the third EEVI void and configured to cause the third EEVI to resonate at a second secondary resonate frequency; and fourth EEVI tuning circuitry coupled in parallel to the fourth EEVI void and configured to cause the fourth EEVI to resonate at the second secondary resonate frequency.

16. The EEVA apparatus of claim 15 wherein the third EEVI tuning circuitry and the fourth EEVI tuning circuitry are configured to tune the second secondary resonate frequency to equal the second primary resonate frequency to cause the third EEVI and the fourth EEVI to substantially reflect the electrical current toward the second EEVA.

17. The EEVA apparatus of claim 16 wherein the second EEVA, the third EEVI, and the fourth EEVI are configured to collectively form a second dipole antenna.

18. The EEVA apparatus of claim 14 wherein the EEVA void, the first EEVI void, the second EEVI void, the second EEVA void, the third EEVI void, and the fourth EEVI void are filled with a selected material.

19. The EEVA apparatus of claim 1 wherein the conductive plane is a polygonal-shaped conductive plane or an elliptical-shaped conductive plane.

20. The EEVA apparatus of claim 1 wherein the EEVA is further configured to absorb an incoming electromagnetic wave corresponding to an incoming RF signal.

* * * * *